US010144231B2

(12) United States Patent
Hamano

(10) Patent No.: US 10,144,231 B2
(45) Date of Patent: Dec. 4, 2018

(54) CARRIAGE AND LIQUID JET RECORDING APPARATUS HAVING POSITIONABLE LIQUID JET HEAD

(71) Applicant: SII Printek Inc., Chiba-shi, Chiba (JP)

(72) Inventor: Yuichiro Hamano, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/479,591

(22) Filed: Apr. 18, 2017

(65) Prior Publication Data

US 2017/0305176 A1 Oct. 26, 2017

(30) Foreign Application Priority Data

Apr. 21, 2016 (JP) ..... 2016-085303

(51) Int. Cl.
*B41J 25/00* (2006.01)
*B41J 25/34* (2006.01)

(52) U.S. Cl.
CPC ..... *B41J 25/006* (2013.01); *B41J 25/001* (2013.01); *B41J 25/34* (2013.01)

(58) Field of Classification Search
CPC ... B41J 11/008; B41J 2/01; B41J 2/145; B41J 2/14024; B41J 2/1752; B41J 25/006; B41J 25/003; B41J 25/001; B41J 29/04; B41J 29/06
See application file for complete search history.

(56) References Cited

U.S. PATENT DOCUMENTS 8,002,387 B2 * 8/2011 Nishino ..... B41J 2/21 347/49
2009/0185010 A1 * 7/2009 Koseki ..... B41J 2/14209 347/68
2011/0261106 A1 10/2011 Murase

FOREIGN PATENT DOCUMENTS

JP 2010-131853 A 6/2010

* cited by examiner

*Primary Examiner* — Juanita D Jackson
(74) *Attorney, Agent, or Firm* — Brinks Gilson & Lione

(57) ABSTRACT

A carriage includes: a base plate; a liquid jet head including a support plate attached to the base plate; a first engagement portion formed on one end in a Y direction of the support plate; a fixing tool for positioning and fixing the support plate with respect to the base plate, the fixing tool being fixed to the base plate slidably in an X direction by screws and engaged with the first engagement portion; and a flat spring portion that presses the fixing tool toward the base plate. The fixing tool allows movement in the Y direction of the first engagement portion with respect to the fixing tool, and restricts movement in the X direction of the first engagement portion and movement in a thickness direction of the base plate of the first engagement portion with respect to the fixing tool.

5 Claims, 17 Drawing Sheets

CARRIAGE AND LIQUID JET RECORDING APPARATUS HAVING POSITIONABLE LIQUID JET HEAD

RELATED APPLICATIONS

This application claims priority under 35 U.S.C. § 119 to Japanese Patent Application No. 2016-085303 filed on Apr. 21, 2016, the entire content of which is hereby incorporated by reference.

BACKGROUND OF THE INVENTION

Technical Field

The present invention relates to a carriage and a liquid jet recording apparatus.

Related Art

Conventionally, there has been known a liquid jet recording apparatus which records characters or images on a recording medium using a liquid jet head (ink jet head) including a plurality of nozzle holes which eject ink. The liquid jet recording apparatus is provided with a plate-like carriage whose scanning direction is one direction and a liquid jet head which is attached onto the carriage. The liquid jet head is provided with a nozzle plate which faces a recording medium. The nozzle plate includes a plurality of nozzle holes which are arranged in the other direction perpendicular to the one direction.

The attachment position accuracy of the liquid jet head (nozzle holes) with respect to the carriage directly affects the quality of images or characters recorded on a recording medium. Thus, various techniques for positioning a liquid jet head with respect to a carriage are disclosed.

For example, there is disclosed a technique provided with a lever which turns and makes engagement with respect to a carriage to thereby detachably fix a liquid jet head (JP 2010-131853 A, for example). This technique enables the liquid jet head to be positioned with respect to the carriage in one direction, the other direction, and a height direction (a thickness direction of the carriage) which is perpendicular to the one direction and the other direction with a turning operation and an engagement operation of the lever.

SUMMARY OF THE INVENTION

However, in the above conventional technique, positioning in the one direction, positioning in the other direction, and positioning in the height direction are independent of one another. Thus, for example, it is not possible to adjust only a position in the height direction while maintaining positioning in the other two directions, specifically, the one direction and the other direction. Thus, it is disadvantageously difficult to perform position adjustment of the liquid jet head with respect to the carriage.

The present invention has been made in view of the above circumstances and provides a carriage and a liquid jet recording apparatus capable of performing positioning of a liquid jet head with ease and high accuracy.

To solve the above problem, a carriage according to the present invention includes: a base movable in a first direction; a liquid jet head including a support plate attached to the base, the support plate being elongated in a second direction that intersects the first direction and extends along a plane direction of the base; a first engagement portion formed on one end in the second direction of the support plate; a fixing tool for positioning and fixing the support plate with respect to the base, the fixing tool being fixed to the base slidably in the first direction by a fixing member configured to be attachable/detachable with respect to the base and engaged with the first engagement portion; and a first pressing portion configured to press the fixing tool toward the base, wherein the support plate is supported on one face of the base turnably along the one face, and the fixing tool is slidable in the first direction using the fixing member as a guide, and configured to allow movement in the second direction of the first engagement portion with respect to the fixing tool, and restrict movement in the first direction of the first engagement portion and movement in a thickness direction of the base of the first engagement portion with respect to the fixing tool.

Such a configuration makes it possible, when, for example, a screw is employed as the fixing member, to slide the fixing tool in the first direction with the screw temporarily fixed to position the liquid jet head in the first direction. At this time, since the screw is in a temporarily-fixed state, the fixing tool slightly lifts off. However, the fixing tool is pressed by the first pressing portion. Thus, it is possible to also preform positioning in the thickness direction of the liquid jet head (in the thickness direction of the base, hereinbelow, merely referred to as the thickness direction). Accordingly, it is possible to perform position adjustment in the second direction of the liquid jet head while maintaining positioning in the first direction and the thickness direction. Thus, it is possible to perform positioning of the liquid jet head with ease and high accuracy.

The carriage according to the present invention further includes: a positioning pin detachably attached to the base and capable of positioning the fixing tool in the first direction and the thickness direction; and a second pressing portion configured to press the fixing tool toward the positioning pin.

The positioning in the first direction and the thickness direction of the fixing tool can be more easily performed by using the positioning pin and the second pressing portion in this manner.

In the carriage according to the present invention, the positioning pin includes: a tapered portion whose diameter is gradually reduced toward a tip thereof; and a pin thread portion disposed on the tip of the tapered portion and screwed with the base along the thickness direction of the base, and a corner of the fixing tool abuts against the tapered portion.

When the corner of the fixing tool abuts against the tapered portion, component forces in two directions including the first direction and the thickness direction act on the fixing tool. In this manner, it is possible to position the fixing tool in the first direction and the thickness direction by the positioning pin having a simplified structure.

In the carriage according to the present invention, the first pressing portion and the second pressing portion are formed of a flat spring, the fixing tool includes an inclined plane formed on a face opposite to the base at a side part opposite to the positioning pin, and the first pressing portion and the second pressing portion abut against the inclined plane.

Such a configuration makes it possible to integrate the first pressing portion and the second pressing portion with each other and achieve a simple structure. Thus, the carriage can be provided at a low cost.

A liquid jet recording apparatus according to the present invention includes: the carriage described above; a liquid jet head disposed on the carriage; a scanning unit configured to move the carriage; a liquid storage body configured to store liquid; and a liquid supply tube configured to circulate the liquid, the liquid supply tube being laid between the liquid jet head and the liquid storage body.

Such a configuration makes it possible to provide the liquid jet recording apparatus capable of performing positioning of the liquid jet head with ease and high accuracy.

The present invention makes it possible, when, for example, a screw is employed as the fixing member, to slide the fixing tool in the first direction with the screw temporarily fixed to position the liquid jet head in the first direction. At this time, since the screw is in a temporarily-fixed state, the fixing tool slightly lifts off. However, the fixing tool is pressed by the first pressing portion. Thus, it is possible to also preform positioning in the thickness direction of the liquid jet head (in the thickness direction of the base, hereinbelow, merely referred to as the thickness direction). Accordingly, it is possible to perform position adjustment in the second direction of the liquid jet head while maintaining positioning in the first direction and the thickness direction. Thus, it is possible to perform positioning of the liquid jet head with ease and high accuracy.

DETAILED DESCRIPTION OF THE INVENTION

Hereinbelow, an embodiment according to the present invention will be described with reference to the drawings. In the following embodiment, a liquid jet recording apparatus which jets ink as liquid to perform recording on a recording medium will be described as an example.

(Liquid Jet Recording Apparatus)

Figure 1:
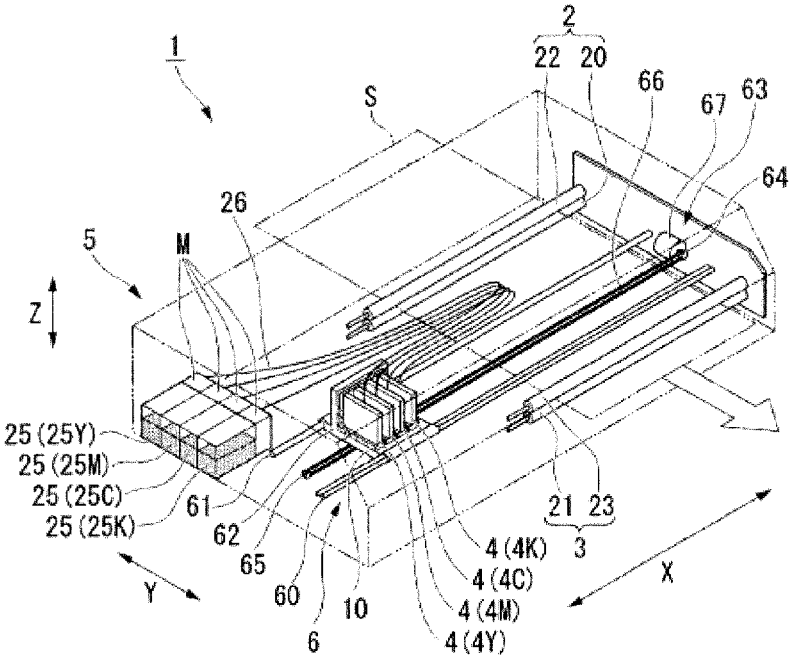
FIG. 1 is a perspective view of a liquid jet recording apparatus in an embodiment of the present invention.

FIG. 1 is a perspective view of a liquid jet recording apparatus 1.

The liquid jet recording apparatus 1 is a so-called ink jet printer and provided with a pair of conveyance mechanisms 2, 3 which conveys a recording medium S such as paper, a liquid jet head 4 which jets ink droplets onto the recording medium S, a liquid supply unit 5 which supplies ink to the liquid jet head 4, and a scanning unit 6 which moves the liquid jet head 4 in a direction (sub-scanning direction) that is substantially perpendicular to a conveyance direction (main-scanning direction) of the recording medium S.

In the following description, the sub-scanning direction is referred to as an X direction, the main-scanning direction is referred to as a Y direction, and a direction perpendicular to both the X direction and the Y direction is referred to as a Z direction. The liquid jet recording apparatus 1 is placed with the X and Y directions aligned with the horizontal direction and the Z direction aligned with the gravity direction (up-down direction) to be used.

That is, the liquid jet head 4 moves on the recording medium S along the horizontal direction (X and Y directions) when the liquid jet recording apparatus 1 is placed. The liquid jet head 4 jets ink droplets downward in the gravity direction (downward in the Z direction) so that the ink droplets land on the recording medium S.

The conveyance mechanism 2 is provided with a grid roller 20 which extends in the X direction, a pinch roller 22 which extends parallel to the grid roller 20, and a drive mechanism (not specifically illustrated) such as a motor which rotates the grid roller 20 around a shaft thereof. Similarly, the conveyance mechanism 3 is provided with a grid roller 21 which extends in the X direction, a pinch roller 23 which extends parallel to the grid roller 21, and a drive mechanism (not specifically illustrated) which rotates the grid roller 21 around a shaft thereof.

The liquid supply unit 5 is provided with a liquid storage body 25 which stores ink therein and a liquid supply tube 26 which connects the liquid storage body 25 to the liquid jet head 4. The liquid storage body 25 includes a plurality of ink tanks, for example, ink tanks 25Y, 25M, 25C, 25K which respectively store therein four kinds of ink, specifically, yellow ink, magenta ink, cyan ink and black ink and are arranged side by side. Each of the ink tanks 25Y, 25M, 25C, 25K is provided with a pump motor M so that ink can be pressed and moved to the liquid jet head 4 through the liquid supply tube 26. The liquid supply tube 26 includes a flexible hose which has flexibility and is capable of following the action of a carriage 62 which supports the liquid jet head 4.

The liquid storage body 25 is not limited to the ink tanks 25Y, 25M, 25C, 25K which respectively store therein four kinds of ink, specifically, yellow ink, magenta ink, cyan ink and black ink. The liquid storage body 25 may include ink tanks which store more colors of ink.

The scanning unit 6 is provided with a pair of guide rails 60, 61 which extend in the X direction, the carriage 62 which is slidable along the pair of guide rails 60, 61, and a drive mechanism 63 which moves the carriage 62 in the X direction. The drive mechanism 63 is provided with a pair of pulleys 64, 65 which is disposed between the guide rails 60, 61, an endless belt 66 which is wound around the pair of pulleys 64, 65, and a drive motor 67 which drives the pulley 64 to rotate.

The pulley 64 is disposed between one end of the guide rail 60 and one end of the guide rail 61 and arranged at intervals in the X direction, and the pulley 65 is disposed between the other end of the guide rail 60 and the other end of the guide rail 61 and arranged at intervals in the X direction. The endless belt 66 is disposed between the guide rails 60, 61. The carriage 62 is coupled to the endless belt 66.

A plurality of liquid jet heads 4 are attached to the carriage 62. In the present embodiment, four liquid jet heads 4, specifically, liquid jet heads 4Y, 4M, 4C, 4K which respectively jet yellow (Y) ink, magenta (M) ink, cyan (C) ink, and black (K) ink are attached to the carriage 62. All the liquid jet heads 4Y, 4M, 4C, 4K have the same configuration except the color of ink supplied thereto. Thus, in the following description, the liquid jet heads 4Y, 4M, 4C, 4K will be collectively described as the liquid jet heads 4.

(Liquid Jet Head)

Figure 2:
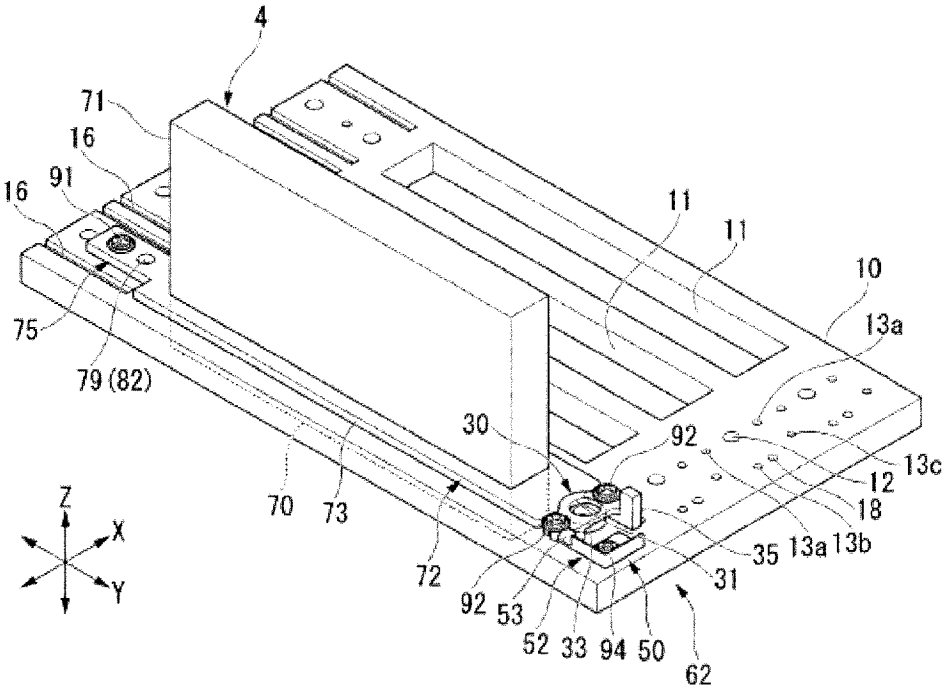
FIG. 2 is a perspective view illustrating a carriage with one liquid jet head attached in the embodiment of the present invention.
Figure 3:
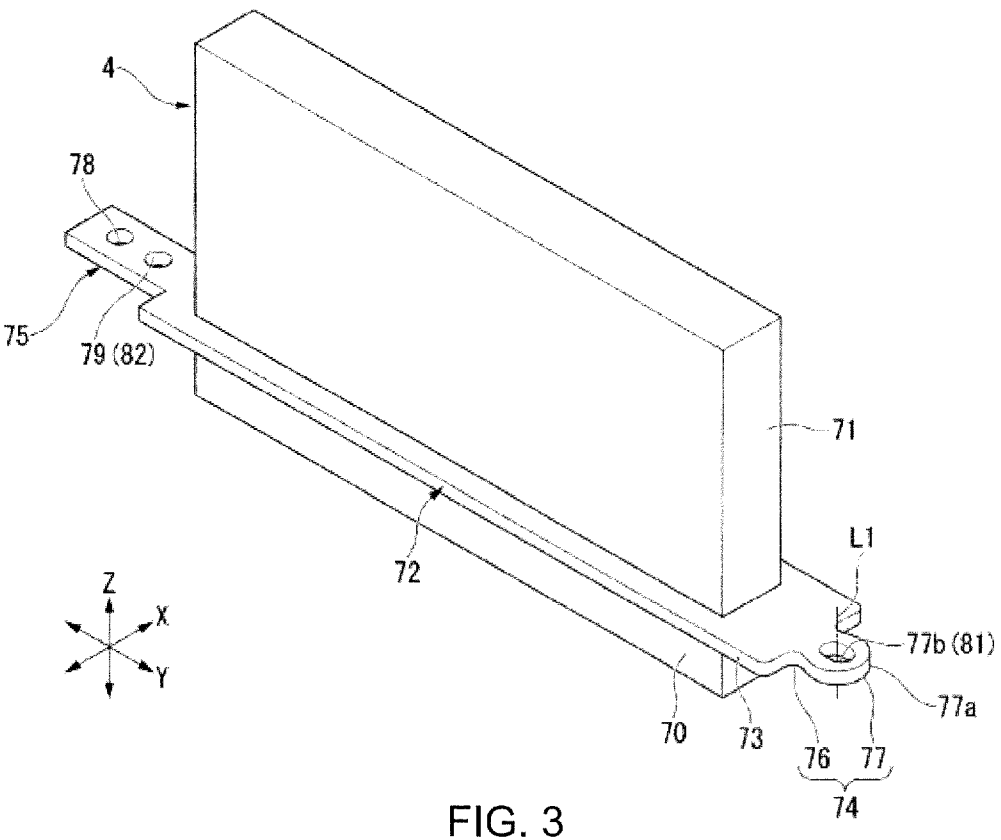
FIG. 3 is a perspective view of the liquid jet head in the embodiment of the present invention.

FIG. 2 is a perspective view illustrating the carriage 62 with one liquid jet head 4 attached. FIG. 3 is a perspective view of the liquid jet head 4. The four liquid jet heads 4 are actually attached to the carriage 62. However, for easy understanding of the description, a state in which only one liquid jet head 4 is attached to the carriage 62 is illustrated (the same applies to the drawings used in the following description).

As illustrated in FIGS. 2 and 3, the liquid jet head 4 is provided with a head chip 70 which ejects ink droplets and is located in a lower part in the Z direction and a head body 71 which is located on the upper part in the Z direction of the head chip 70. The entire liquid jet head 4 has a substantially rectangular parallelepiped shape elongated in the Y direction.

The head chip 70 includes an actuator plate (not illustrated) which has a substantially rectangular parallelepiped shape elongated in the Y direction and a nozzle plate (not illustrated) which is disposed on the Z-direction lower end face of the actuator plate. The actuator plate is formed of a piezoelectric material such as lead zirconate titanate (PZT) and includes a plurality of channels which can be filled with ink. The channels are formed at predetermined intervals in the Y direction.

The nozzle plate is made of a film material such as polyimide or metal and has a sheet-like shape. The nozzle plate includes a plurality of nozzle holes which communicate with the respective channels. That is, the nozzle holes are arranged at predetermined intervals in the Y direction.

The capacity of each of the channels changes by the application of desired drive voltage to the actuator plate. Accordingly, ink is ejected from the each of the nozzle holes.

The head body 71 includes a liquid circulation unit (not illustrated) to which the liquid supply tube 26 (refer to FIG. 1) is connected and a control unit (not illustrated) for applying desired drive voltage to the head chip 70. Ink flowing from the liquid supply tube 26 is supplied to the head chip 70 through the liquid circulation unit. The liquid circulation unit functions as a pressure buffer. When ink is supplied to the liquid circulation unit through the liquid supply tube 26, the liquid circulation unit temporarily stores the ink in a storage chamber inside thereof and then supplies a predetermined amount of ink to the head chip 70.

Under such a configuration, as illustrated in FIGS. 1 and 2, for example, the recording medium S is conveyed in the conveyance direction Y by the pair of conveyance mechanisms 2, 3 and, at the same time, each of the liquid jet heads 4 is reciprocated in the scanning direction X through the carriage 62 by the scanning unit 6. During this operation, ink is ejected from each of the nozzle holes of each of the liquid jet heads 4. As a result, various kinds of information such as characters or images are recorded on the recording medium S using the four colors of ink.

(Support Plate)

The head chip 70 of the liquid jet head 4 is provided with a support plate 72. The liquid jet head 4 is fixed to the carriage 62 through the support plate 72.

The support plate 72 includes a plate body 73 which projects from the periphery of the head chip 70 along the X-Y plane and has a rectangular shape elongated in the Y direction. A first engagement portion 74 extends from one end in the Y direction of the plate body 73. A second engagement portion 75 extends from the other end in the Y direction of the plate body 73.

The first engagement portion 74 and the second engagement portion 75 are used for performing positioning between the carriage 62 and the support plate 72 (the liquid jet head 4) and fixing the support plate 72 to the carriage 62.

The first engagement portion 74 includes a head 77 which has a substantially annular shape and extends toward one side in the Y direction from substantially the X-direction center at the one end in the Y direction of the plate body 73 through a constricted portion 76. The head 77 includes an outer peripheral face 77*a* which is formed in a circular shape centered on a straight line L1 extending along the thickness direction of the plate body 73. The head 77 includes an inner peripheral face 77*b* which is formed in an elliptical shape slightly elongated along the Y direction.

The inner peripheral face 77*b* functions as an engagement portion side first reference hole 81 for determining the relative position between the carriage 62 and the support plate 72. The inner peripheral face 77*b* is located at substantially the same position as a base side first reference hole 12 of a base plate (base) 10 (described below) when viewed from the Z direction with the liquid jet head 4 attached to the carriage 62. The width of the inner peripheral face 77*b* is set to be substantially equal to the hole diameter of the base side first reference hole 12. The length of the inner peripheral face 77*b* is set to be slightly larger than the hole diameter of the base side first reference hole 12. In the following description, the inner peripheral face 77*b* is referred to as the engagement portion side first reference hole 81.

On the other hand, the second engagement portion 75 extends toward the other side in the Y direction from substantially the X-direction center at the other end in the Y direction of the plate body 73. The second engagement portion 75 is formed in a substantially rectangular shape elongated in the Y direction. The second engagement portion 75 includes two through holes 78, 79 which are arranged side by side in the Y direction. The through hole 78 which is located at the other side in the Y direction of the second engagement portion 75 functions as a screw hole into which a screw 91 (described below) is inserted.

In the two through holes 78, 79, the other through hole 79 functions as an engagement portion side second reference hole 82 for determining the relative position between the carriage 62 and the support plate 72. The through hole 79 is located at substantially the same position as a base side second reference hole 14 of the base plate 10 when viewed from the Z direction with the liquid jet head 4 attached to the carriage 62. The hole diameter of the through hole 79 is set to be substantially equal to the hole diameter of the base side second reference hole 14. In the following description, the through hole 79 is referred to as the engagement portion side second reference hole 82.

(Carriage)

Figure 4:
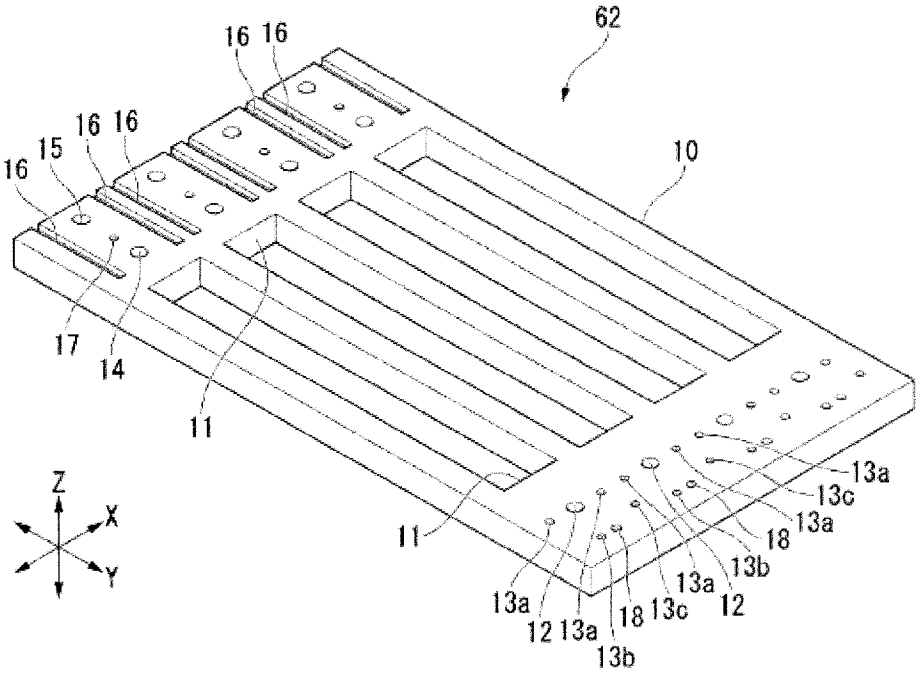
FIG. 4 is a perspective view of a base plate of the carriage in the embodiment of the present invention.

FIG. 4 is a perspective view of the base plate 10 of the carriage 62.

As illustrated in FIGS. 2 and 4, the carriage 62 includes the base plate 10. The base plate 10 is slidably coupled to the pair of guide rails 60, 61 (refer to FIG. 1) and coupled to the endless belt 66 (refer to FIG. 1).

The base plate 10 includes a plurality of attachment openings 11 (for example, four attachment openings 11 in the present embodiment) which are arranged side by side in the X direction. Each of the attachment openings 11 has a substantially rectangular shape elongated in the Y direction. Each of the attachment openings 11 is slightly larger than the shape of the outer peripheral face of the head chip 70.

The head chip 70 of each of the liquid jet heads 4 is inserted into the corresponding attachment opening 11 from the upper side in the Z direction. That is, the liquid jet heads 4 are arranged side by side in the X direction with the longitudinal direction aligned with the Y direction so as to correspond to the respective attachment openings 11.

The base plate 10 includes base side first reference holes 12 each of which is formed at a position corresponding to the first engagement portion 74 (refer to FIG. 3) of the support plate 72 at the one side in the Y direction of the corresponding attachment opening 11. Each of the base side first reference holes 12 overlaps the first reference hole 81 of the first engagement portion 74 in the Z direction (the thickness direction of the base plate 10).

Further, first female thread portions 13*a* are formed in an engraved form on both sides in the X direction across each of the base side first reference holes 12. Further, second female thread portions 13*b* and third female thread portions 13*c* are formed in an engraved form at the one side in the Y direction with respect to the first female thread portions 13*a*, and positioning holes 18 are formed between the second female thread portions 13*b* and the third female thread portions 13*c*.

The first female thread portion 13*a* is used for fastening and fixing a fixing tool 30 (described below). The second female thread portion 13*b* and the positioning hole 18 are used for fastening and fixing a flat spring portion 50 (described below). The third female thread portion 13*c* is used for screwing a positioning pin 110 (described below) therewith.

The base plate 10 includes female thread portions 17 in an engraved form and base side second reference holes 14. Each of the female thread portions 17 and each of the base side second reference holes 14 are formed at a position corresponding to the second engagement portion 75 (refer to FIG. 3) of the support plate 72 at the other side in the Y direction. The female thread portion 17 is formed at the same position as the through hole 78 of the second engagement portion 75 when viewed from the Z direction. The female thread portion 17 is used for fastening and fixing the liquid jet head 4 to the base plate 10.

The base side second reference hole 14 is formed at the same position as the engagement portion side second reference hole 82 of the second engagement portion 75 when viewed from the Z direction.

The base plate 10 further includes base side third reference holes 15. Each of the base side third reference holes 15 is formed at the opposite side (the other side) of the base side second reference hole 14 across the female thread portion 17. The hole diameter of the base side second reference hole 14, the hole diameter of the base side third reference hole 15, and the hole diameter of the base side first reference hole 12 are all set to be equal to each other.

The female thread portion 17, the base side second reference hole 14, and the base side third reference hole 15 are arranged side by side in the Y direction. Slide grooves 16 are formed on both sides in the X direction across the female thread portion 17, the base side second reference hole 14, and the base side third reference hole 15. Each of the slide grooves 16 is used for restricting a movement direction of a jig 40 (described below) and elongated in the Y direction.

Figure 5:
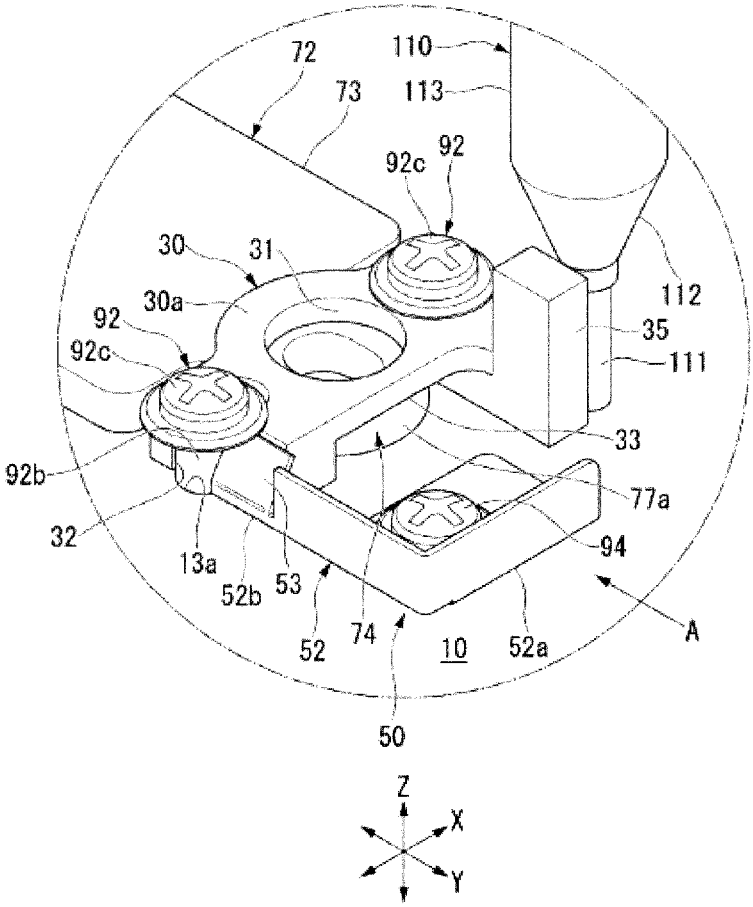
FIG. 5 is a perspective view of a fixing tool viewed from the oblique-upper side in the embodiment of the present invention.
Figure 9:
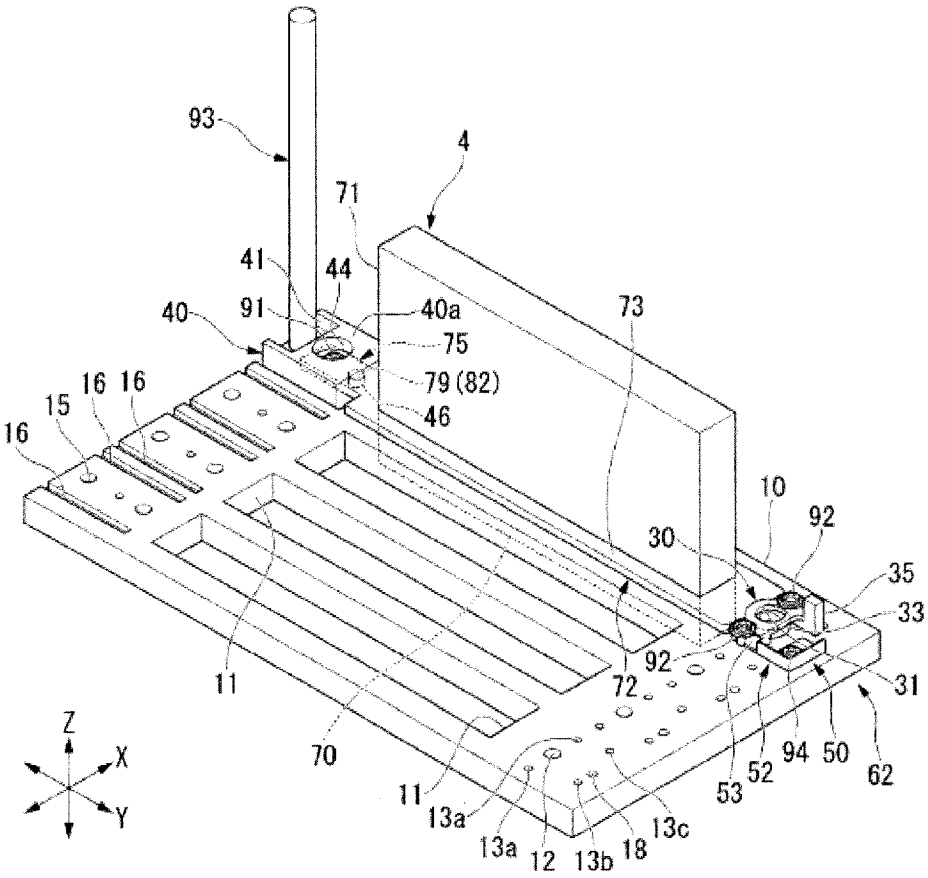
FIG. 9 is a perspective view illustrating the carriage with the liquid jet head attached through the fixing tool and a jig in the embodiment of the present invention.

Under such a configuration, the support plate 72 (the liquid jet head 4) is positioned with respect to the carriage 62 using the fixing tool 30, the jig 40, the flat spring portion 50, a reference pin 93, and the positioning pin 110 (refer to FIGS. 5 and 9). Then, the support plate 72 is fixed to the carriage 62. As a result, the liquid jet head 4 is attached to the carriage 62.

(Fixing Tool)

Figure 6:
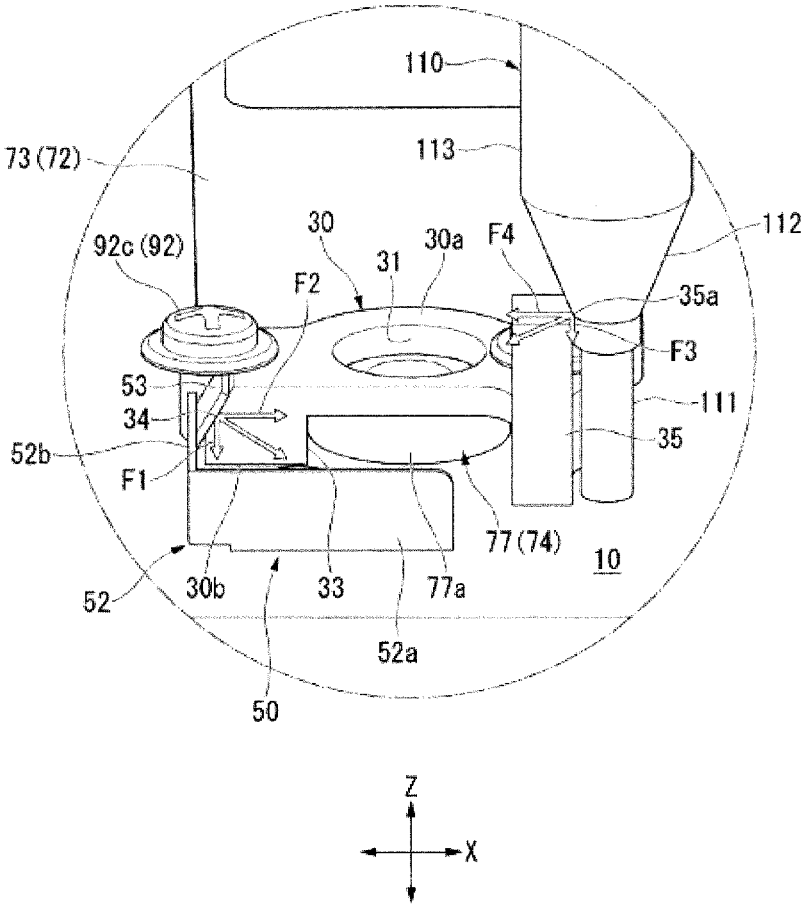
FIG. 6 is a view on arrow A of FIG. 5.
Figure 7:
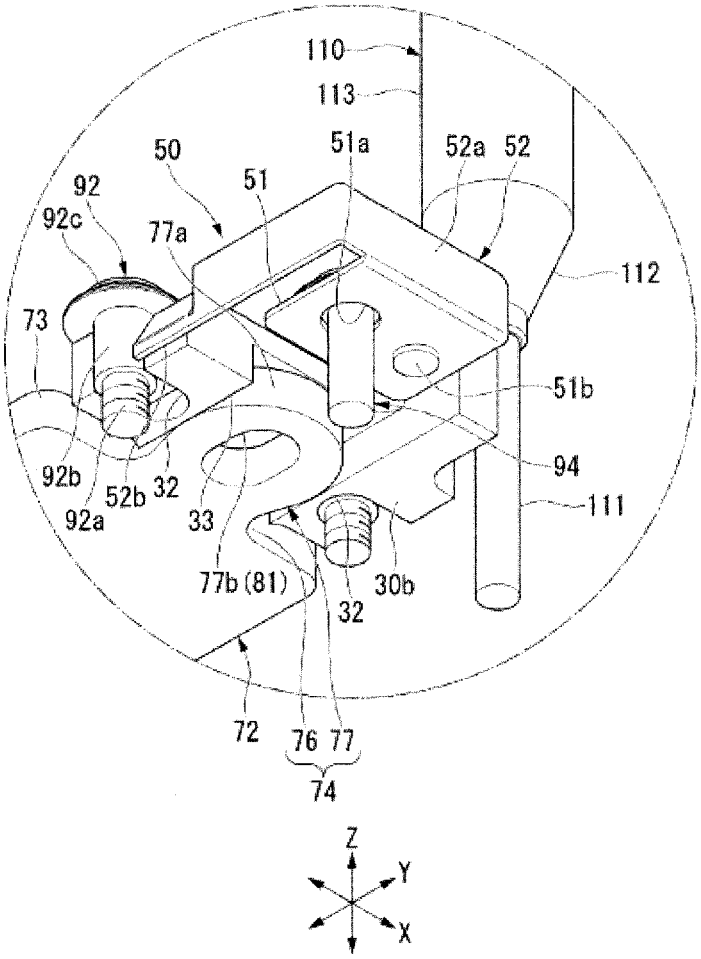
FIG. 7 is a perspective view of the fixing tool viewed from the oblique-lower side in the embodiment of the present invention.
Figure 8:
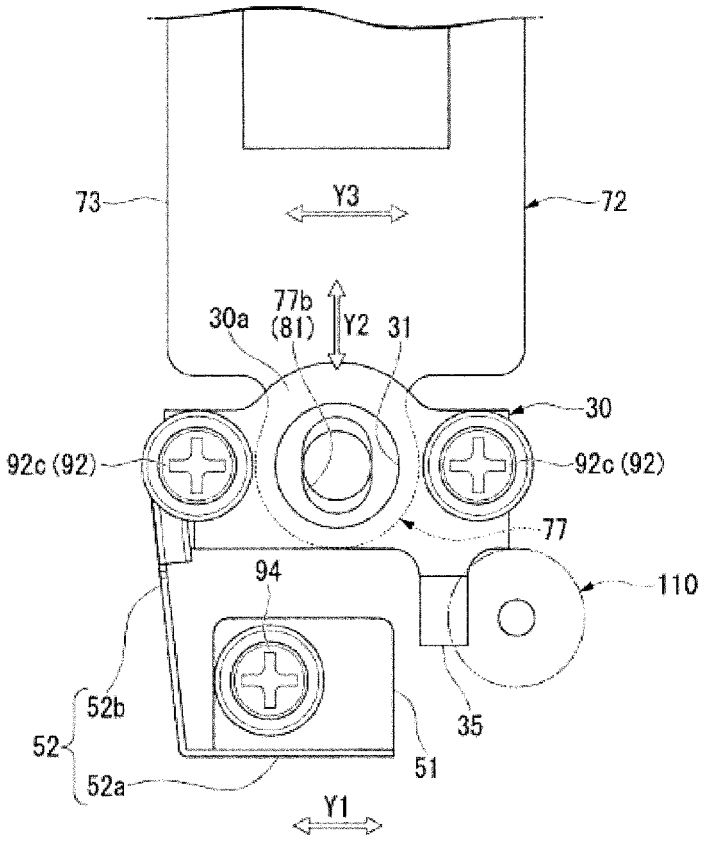
FIG. 8 is a perspective view of the fixing tool viewed from the upper side in a Z direction in the embodiment of the present invention.

FIG. 5 is a perspective view of the fixing tool 30 viewed from the oblique-upper side. FIG. 6 is a view on arrow A of FIG. 5. FIG. 7 is a perspective view of the fixing tool 30 viewed from the oblique-lower side. FIG. 8 is a plan view of the fixing tool 30 viewed from the upper side in the Z direction.

As illustrated in FIGS. 2, and 5 to 8, the fixing tool 30 is attached to the first engagement portion 74 of the support plate 72. The fixing tool 30 is formed in a rectangular parallelepiped shape slightly elongated in the X direction so as to cover the base side first reference hole 12 and the female thread portions 13 of the base plate 10.

The fixing tool 30 includes a fixing tool side first reference hole 31 which is formed on substantially the X-direction center of the fixing tool 30 and communicates with the engagement portion side first reference hole 81 of the first engagement portion 74 and the base side first reference hole 12 of the base plate 10. The hole diameter of the fixing tool side first reference hole 31 is set to be larger than the diameter of the engagement portion side first reference hole 81 of the first engagement portion 74. Thus, the engagement portion side first reference hole 81 of the first engagement portion 74 and the surrounding areas of the engagement portion side first reference hole 81 are exposed through the fixing tool side first reference hole 31.

The fixing tool 30 includes first grooves 32 which are formed on both sides in the X direction, that is, at positions corresponding to the female thread portions 13 of the base plate 10. The first grooves 32 are formed by cutting both X-direction ends of the fixing tool 30 so that screws 92 which are screwed into the female thread portions 13 can be inserted into the first grooves 32. Each of the first grooves 32 is formed in a substantially semielliptical shape in plan view in the Z direction.

The screw 92 is a so-called stepped screw. That is, the screw 92 includes a small-diameter shaft 92*a* which is formed on the tip, a large-diameter shaft 92*b* which has a larger diameter than the small-diameter shaft 92*a* through a step, and a head 92*c* which is formed on the base end of the large-diameter shaft 92*b* at the side opposite to the small-diameter shaft 92*a*. The small-diameter shaft 92*a*, the large-diameter shaft 92*b*, and the head 92*c* are integrally formed. A male thread is formed in an engraved form on the small-diameter shaft 92*a*. On the other hand, no male thread is formed on the large-diameter shaft 92*b*.

On the other hand, the groove width of the first groove 32 is set to a groove width that enables the insertion of the large-diameter shaft 92*b* of the screw 92 into the first groove 32 and disables the insertion of the head 92*c* (flat washer) of the screw 92 into the first groove 32. Specifically, the groove width of the first groove 32 is set to a value that enables a tiny space to be ensured between the first groove 32 and the large-diameter shaft 92*b* of the screw 92.

Thus, as specifically illustrated in FIG. 8, the fixing tool 30 is slidable in the X direction (refer to arrow Y1 in FIG. 8) and unslidable in the Y direction with respect to the base plate 10.

A lower face 30*b* in the Z direction of the fixing tool 30 includes a second groove 33 which is formed along the Y direction at substantially the X-direction center. The first engagement portion 74 of the support plate 72 is inserted into the second groove 33. The groove width of the second groove 33 is set to be substantially equal to the diameter of the outer peripheral face 77*a* of the head 77 of the first engagement portion 74.

In other words, the head 77 having the circular outer peripheral face 77*a* is fitted in the second groove 33 elongated in the Y direction with a space ensured between the second groove 33 and the constricted portion 76 of the first engagement portion 74. Thus, as specifically illustrated in FIG. 7, the first engagement portion 74 (the support plate 72) is slidable in the Y direction (refer to arrow Y2 in FIG. 8) and turnable along the plane direction of the base plate 10 (refer to arrow Y3 in FIG. 8) with respect to the fixing tool 30. Further, the first engagement portion 74 is unslidable in the X direction with respect to the fixing tool 30.

An upper face 30*a* of the fixing tool 30 includes an inclined plane 34 which is located on one end in the X direction at the one side in the Y direction with respect to the first groove 32 and formed by removing a corner of the fixing tool 30. Further, a positioning pole 35 is integrally formed on one end in the Y direction of the fixing tool 30 at the other end in the X direction. The positioning pole 35 is formed in a substantially quadrangular prism shape and projects toward the upper side in the Z direction from the fixing tool 30.

The flat spring portion 50 abuts against the inclined plane 34 formed in this manner. The positioning pin 110 abuts against a corner 35*a* at the upper end in the Z direction of the positioning pole 35.

(Flat Spring Portion)

The flat spring portion 50 includes a base portion 51 which has a substantially rectangular shape slightly elongated in the X direction so as to cover the second female thread portion 13*b* and the positioning hole 18 of the base plate 10. A through hole 51*a* which allows a screw 94 to be inserted therein is formed on the base portion 51 at a position corresponding to the second female thread portion 13*b*. On the other hand, a positioning projection 51*b* which is fittable with the positioning hole 18 is formed, in a projecting manner, on the base portion 51 at a position corresponding to the positioning hole 18.

The screw 94 inserted in the through hole 51*a* of the base portion 51 is screwed with the second female thread portion 13*b* of the base plate 10 while the positioning projection 51*b* of the base portion 51 is fitted with the positioning hole 18 of the base plate 10. Accordingly, the base portion 51 is relatively unmovably fastened and fixed to the base plate 10.

A base end portion 52*a* of a spring body 52 which is formed in a substantially L shape is joined to one side at the one side in the Y direction of the base portion 51. The base end portion 52*a* of the spring body 52 is joined to the base portion 51 by bending the one side of the base portion 51 in a rising manner.

On the other hand, a tip portion 52*b* of the spring body 52 extends from the base end portion 52*a* of the spring body 52 up to the inclined plane 34 of the fixing tool 30. The tip portion 52*b* includes a pressing portion 53 which obliquely extends in a bent manner toward the inclined plane 34 so as to lean against the inclined plane 34. The pressing portion 53 is in surface contact with the inclined plane 34 of the fixing tool 30.

The spring body 52 is formed to elastically press the one end in the X direction of the fixing tool 30 toward the other end thereof by the tip portion 52*b*. The pressing portion 53 which is formed on the tip portion 52*b* of the spring body 52 is in surface contact with the inclined plane 34 of the fixing tool 30. Thus, as specifically illustrated in FIG. 6, a pressing force F1 toward the lower side in the Z direction and a pressing force F2 toward the other end in the X direction act on the one end in the X direction of the fixing tool 30.

(Positioning Pin)

The positioning pin 110 is detachably attached to the base plate 10 at the other end in the X direction of the fixing tool 30.

As specifically described in FIGS. 6 and 7, the positioning pin 110 is used for positioning the fixing tool 30 in the X direction in cooperation with the flat spring portion 50 and preventing lifting-off of the fixing tool 30 from the base plate 10 during position adjustment of the fixing tool 30. The positioning pin 110 includes a male thread portion 111 which can be screwed into the third female thread portion 13*c* (refer to FIG. 4) of the base plate 10, a tapered portion 112 which is integrally formed with the base end of the male thread portion 111, and a cylindrical holding portion 113 which is integrally formed with the base end of the tapered portion 112.

The tapered portion 112 is formed in a substantially truncated cone shape whose diameter gradually expands from the male thread portion 111 toward the holding portion 113. That is, the outer peripheral face of the tapered portion 112 is inclined with respect to an axial direction of the positioning pin 110 (Z direction). The position of the tapered portion 112 is set in such a manner that the corner 35*a* of the positioning pole 35 of the fixing tool 30 abuts against substantially the axial-direction center of the tapered portion 112 with the male thread portion 111 screwed into the third female thread portion 13*c* of the base plate 10 to some extent. Thus, when the fixing tool 30 is elastically pressed toward the other end in the X direction (toward the positioning pin 110) by the flat spring portion 50, a pressing force F3 toward the lower side in the Z direction and a pressing force F4 toward the one end in the X direction which are generated by a reaction force of the positioning pin 110 act on the positioning pole 35.

(Jig)

Figure 10:
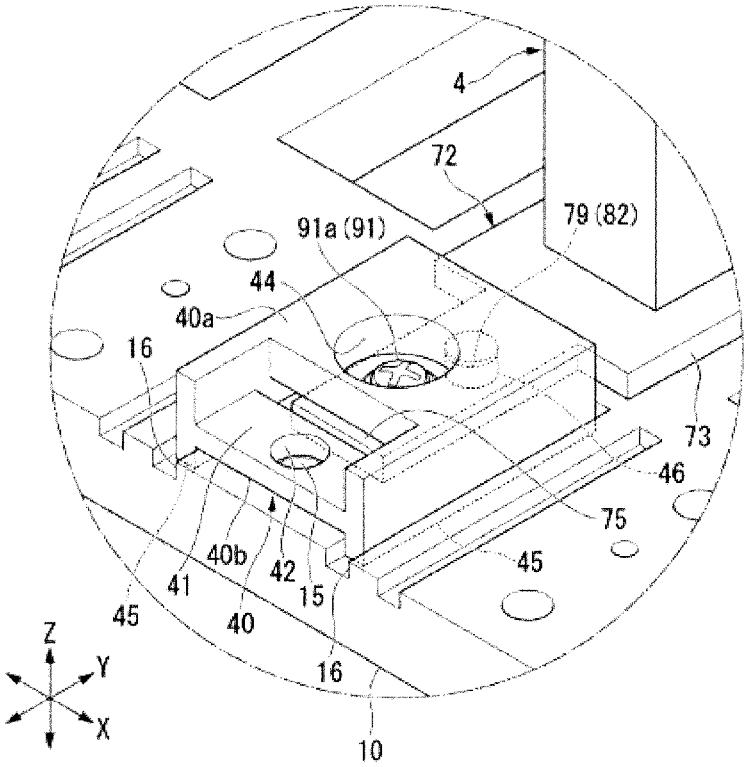
FIG. 10 is a perspective view of the jig viewed from the oblique-upper side in the embodiment of the present invention.
Figure 11:
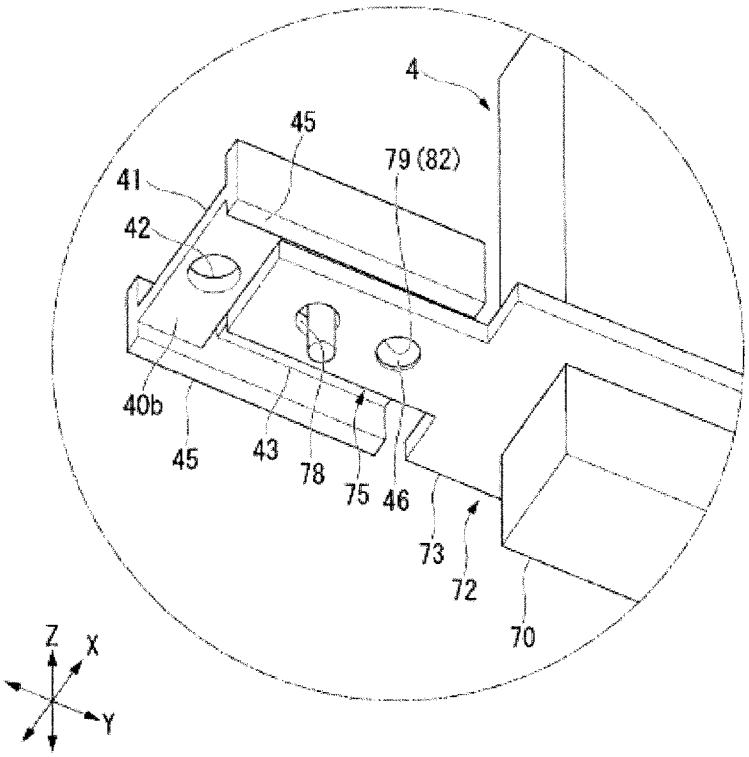
FIG. 11 is a perspective view of the jig viewed from the oblique-lower side in the embodiment of the present invention.
Figure 12:
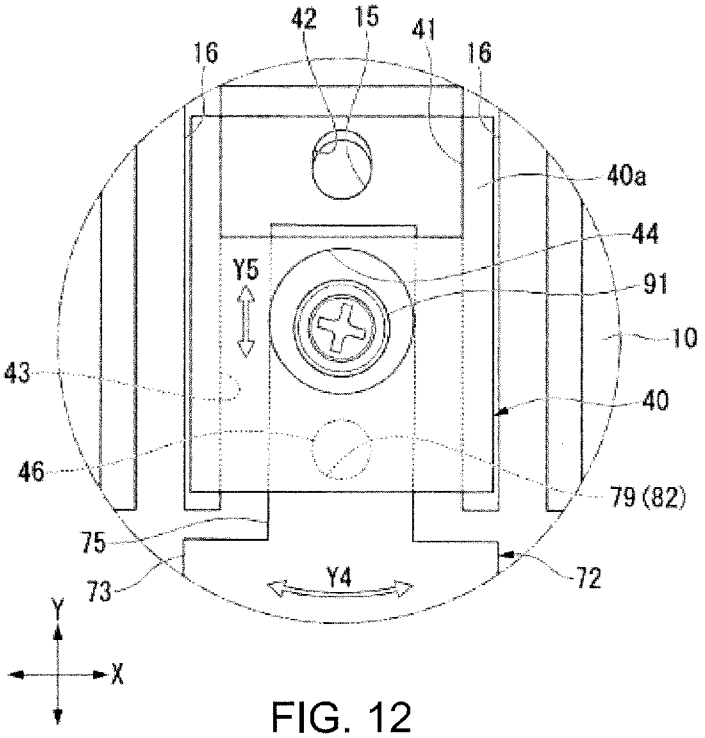
FIG. 12 is a perspective view of the jig viewed from the upper side in the Z direction in the embodiment of the present invention.

FIG. 9 is a perspective view illustrating the carriage 62 with the liquid jet head 4 attached through the fixing tool 30 and the jig 40 and corresponds to FIG. 2. FIG. 10 is a perspective view of the jig 40 viewed from the oblique-upper side. FIG. 11 is a perspective view of the jig 40 viewed from the oblique-lower side. FIG. 12 is a plan view of the jig 40 viewed from the upper side in the Z direction.

As illustrated in FIGS. 9 to 12, the jig 40 is attached to the second engagement portion 75 of the support plate 72. The jig 40 is formed in a rectangular parallelepiped shape slightly elongated in the Y direction so as to cover the female thread portion 17, the base side second reference hole 14, and the base side third reference hole 15 of the base plate 10.

An upper face 40*a* in the Z direction of the jig 40 includes an upper face side recess 41 which is formed at the opposite side (the other side) of the liquid jet head 4 in the Y direction. The upper face side recess 41 includes a jig side third reference hole 42 which is formed on substantially the X-direction center of the upper face side recess 41 and communicates with the base side third reference hole 15 of the base plate 10 when the jig 40 is attached to the second engagement portion 75 of the support plate 72.

The jig side third reference hole 42 is formed in an elliptical shape slightly elongated in the Y direction. That is, the width of the jig side third reference hole 42 is set to be substantially equal to the hole diameter of the base side third reference hole 15. The length of the jig side third reference hole 42 is set to be slightly larger than the hole diameter of the base side third reference hole 15.

The jig 40 includes a lower face side recess 43 which is formed on substantially the X-direction center of a lower face 40*b* along the Y direction at the side closer to the liquid jet head 4 than the upper face side recess 41 is (at the one side in the Y direction). The upper face side recess 41 and the lower face side recess 43 communicate with each other in the Y direction.

The second engagement portion 75 of the support plate 72 is inserted into the lower face side recess 43. The X-direction width of the lower face side recess 43 is set to be slightly larger than the X-direction width of the second engagement portion 75. Thus, as specifically illustrated in FIG. 11, a deviation in the attachment angle of the second engagement portion 75 (a slight movement in the Y direction and the X direction and a slight turn with respect to the plane direction of the base plate 10; refer to arrow Y4 in FIG. 12) is allowed inside the lower face side recess 43.

The jig 40 includes a through hole 44 which is formed at a position corresponding to the through hole 78 of the second engagement portion 75. The through hole 44 functions as a screw hole into which a screw 91 (described below) is inserted. The hole diameter of the through hole 44 is set to be larger than the hole diameter of the through hole 78 of the second engagement portion 75 and larger than the diameter of a head 91*a* of the screw 91. Thus, the through hole 78 of the second engagement portion 75 and the surrounding areas of the through hole 78 are exposed through the through hole 44.

The lower face side recess 43 includes a projection 46 which is formed at a position corresponding to the engagement portion side second reference hole 82 of the second engagement portion 75 and fittable with the engagement portion side second reference hole 82. The projection 46 is fitted with the engagement portion side second reference hole 82 with substantially no backlash. Accordingly, the second engagement portion 75 of the support plate 72 and the jig 40 are positioned with high accuracy and engaged with each other.

The jig 40 includes slide projections 45 which project toward the base plate 10 from both the entire X-direction sides of the jig 40. The slide projections 45 are fitted into the slide grooves 16 of the base plate 10. Thus, as specifically illustrated in FIG. 12, the jig 40 is attached slidably in the Y direction (refer to arrow Y5 in FIG. 12) and unslidably in the X direction with respect to the base plate 10.

(Position Adjustment and Fixing Method of Liquid Jet Head to Base Plate)

Next, a position adjustment and fixing method of the liquid jet head 4 with respect to the base plate 10 will be described.

(Reference Fixing Method)

First, a reference (initial) fixing operation will be described.

Figure 13:
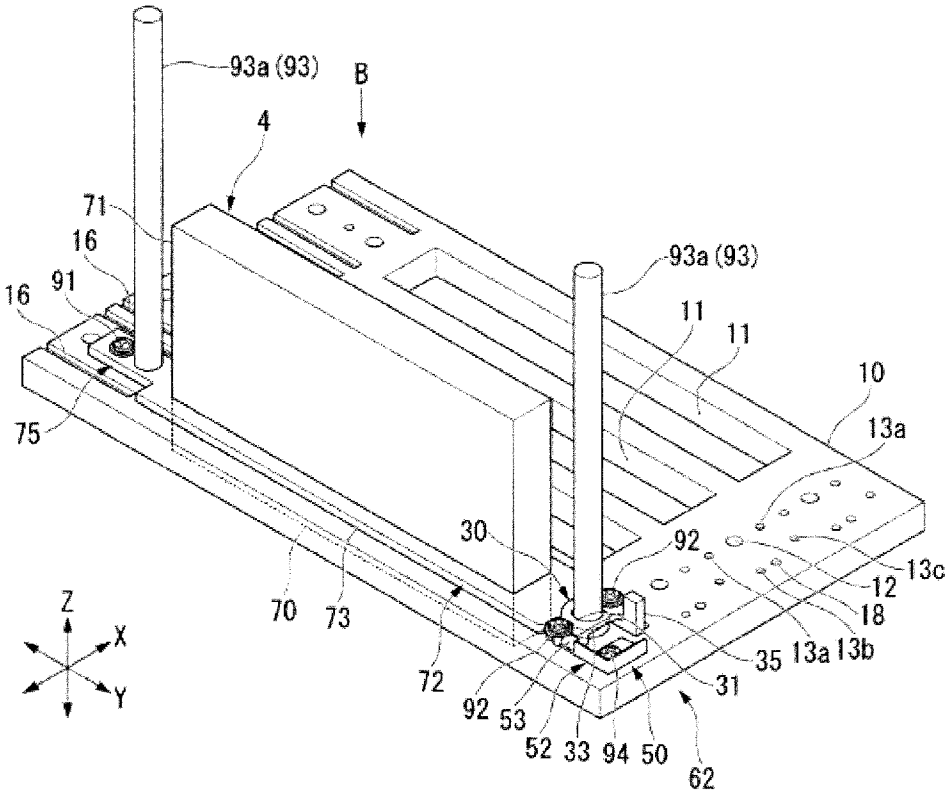
FIG. 13 is a perspective view illustrating a reference fixing method of the liquid jet head with respect to the base plate in the embodiment of the present invention
Figure 14:
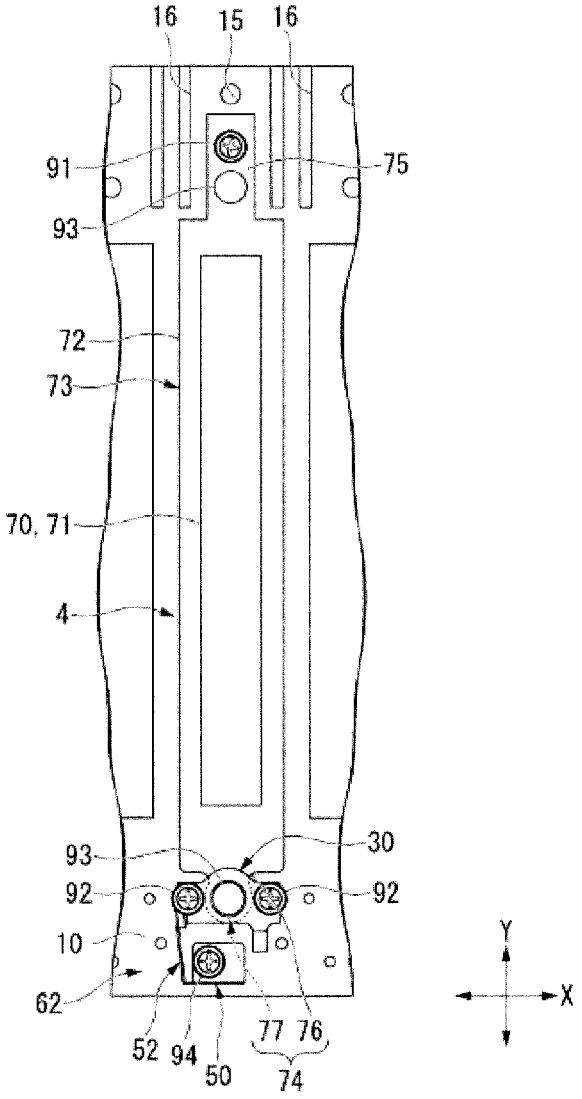
FIG. 14 is a view on arrow B of FIG. 13.

FIG. 13 is a perspective view illustrating a reference fixing method of the liquid jet head 4 with respect to the base plate 10. FIG. 14 is a view on arrow B of FIG. 13.

As illustrated in FIGS. 13 and 14, the fixing tool 30 and the flat spring portion 50 are first set on the first engagement portion 74 (refer to FIG. 3) formed on the support plate 72 of the liquid jet head 4. At this time, the first engagement portion 74 is inserted in the second groove 33 of the fixing tool 30.

Then, the head chip 70 side of the liquid jet head 4 is positioned to face the corresponding attachment opening 11 of the base plate 10 and the head chip 70 is inserted into the attachment opening 11 from the upper side in the Z direction of the base plate 10.

Then, the position of the liquid jet head 4 is roughly adjusted so that the base side first reference hole 12 (refer to FIG. 4) of the base plate 10, the engagement portion side first reference hole 81 of the first engagement portion 74, and the fixing tool side first reference hole 31 of the fixing tool 30 are located at substantially the same position when viewed from the Z direction. At the same time, the position of the liquid jet head 4 is roughly adjusted so that the base side second reference hole 14 of the base plate 10 and the engagement portion side second reference hole 82 formed on the second engagement portion 75 of the support plate 72 are located at substantially the same position when viewed from the Z direction.

Then, a reference pin 93 is inserted into the base side first reference hole 12, the engagement portion side first reference hole 81, and the fixing tool side first reference hole 31. Further, a reference pin 93 is inserted into the base side second reference hole 14 and the engagement portion side second reference hole 82.

Figure 15:
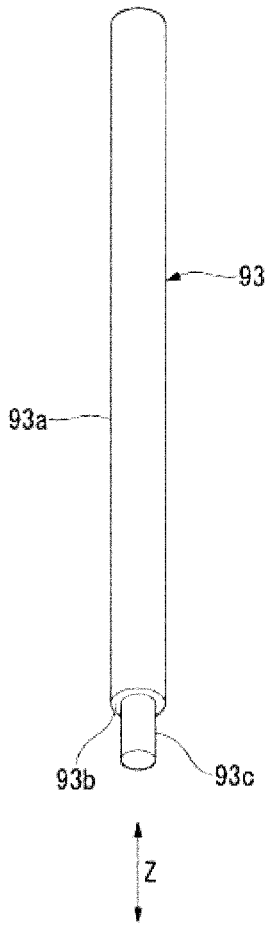
FIG. 15 is a perspective view of a reference pin in the embodiment of the present invention.

FIG. 15 is a perspective view of the reference pin 93.

As illustrated in FIG. 15, the reference pin 93 includes a pin body 93*a* and a reduced-diameter portion 93*c* which is formed on the tip of the pin body 93*a* through a step 93*b* and has a reduced diameter.

In the base side first reference hole 12, the engagement portion side first reference hole 81, and the fixing tool side first reference hole 31, the reduced-diameter portion 93*c* of the reference pin 93 is inserted into the base side first reference hole 12 and the engagement portion side first reference hole 81, and the pin body 93*a* is inserted into the fixing tool side first reference hole 31. The step 93*b* of the reference pin 93 abuts against the head 77 of the first engagement portion 74.

The reduced-diameter portion 93*c* of the reference pin 93 is inserted into the base side second reference hole 14 and the engagement portion side second reference hole 82. The step 93*b* of the reference pin 93 abuts against the second engagement portion 75.

A reference position (initial position) of the support plate 72 (the liquid jet head 4) with respect to the base plate 10 (the carriage 62) is determined by inserting the reference pins 93. In this state, as illustrated in FIG. 5, the screws 92 are inserted from the upper side of the first grooves 32 of the fixing tool 30 and screwed into the first female thread portions 13*a* of the base plate 10.

Further, the screw 91 is inserted into the through hole 78 (refer to FIG. 3) from the upper side of the second engagement portion 75 of the support plate 72 and screwed into the female thread portion 17 (refer to FIG. 4) of the base plate 10. Accordingly, the liquid jet head 4 is fastened and fixed to the base plate 10. Then, the two reference pins 93 are removed to complete the reference fixation of the liquid jet head 4.

The positioning and fixation of the liquid jet head 4 with respect to the base plate 10 as described above is determined by the manufacture accuracy of each component of the carriage 62 and the liquid jet head 4. Thus, the fixing tool 30, the jig 40, the flat spring portion 50, the reference pins 93, and the positioning pin 110 are used to perform fine adjustment of the liquid jet head 4 with respect to the base plate 10. Specifically, angle adjustment in the plane direction (hereinbelow, referred to as θ adjustment) of the liquid jet head 4 (support plate 72) with respect to the base plate 10 and adjustment in the Y direction (hereinbelow, merely referred to as Y-direction adjustment) of the liquid jet head 4 (support plate 72) with respect to the base plate 10 are performed.

(θ Adjustment Method)

First, θ adjustment of the liquid jet head 4 with respect to the base plate 10 will be described.

Figure 16:
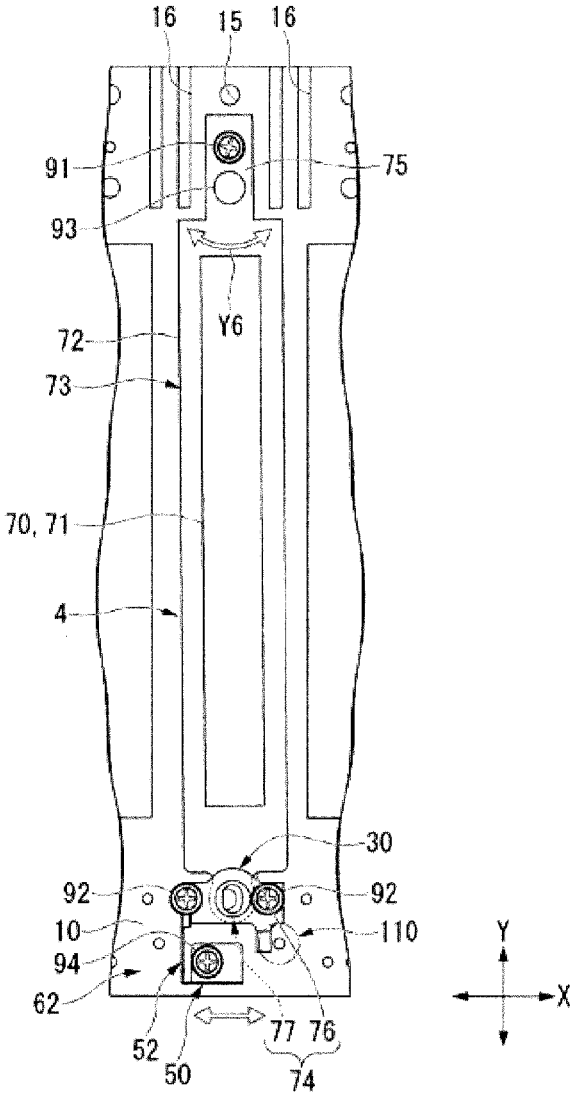
FIG. 16 is an explanatory diagram illustrating a θ-adjustment method of the liquid jet head with respect to the base plate in the embodiment of the present invention.

FIG. 16 is an explanatory diagram illustrating the θ adjustment of the liquid jet head 4 with respect to the base plate 10 and corresponds to FIG. 14.

As illustrated in FIG. 16, when the θ adjustment is performed, the reference pin 93 is first inserted into the engagement portion side second reference hole 82 of the second engagement portion 75 formed on the support plate 72 and the base side second reference hole 14 of the base plate 10. Further, the male thread portion 111 of the positioning pin 110 is screwed into the third female thread portion 13*c* of the base plate 10. Further, the screws 91, 92 which fasten and fix the fixing tool 30 and the second engagement portion 75 are slightly loosened with the positioning pin 110 attached. Accordingly, the fixing tool 30 is brought into a temporarily-fixed state.

In this state, as illustrated in FIG. 8, the fixing tool 30 can be slid only in the X direction with respect to the base plate 10 (refer to arrow Y1 in FIGS. 8 and 16). Further, the first engagement portion 74 (the support plate 72) is slidable in the Y direction (refer to arrow Y2 in FIG. 8) and turnable along the plane direction of the base plate 10 (refer to arrow Y3 in FIG. 8) with respect to the fixing tool 30. Further, the first engagement portion 74 is unslidable in the X direction with respect to the fixing tool 30.

Thus, when the fixing tool 30 is slid with respect to the base plate 10, the first engagement portion 74 turns while moving following the slide of the fixing tool 30. As a result, the support plate 72 turns around the reference pin 93 on the second engagement portion 75 (refer to arrow Y6 in FIG. 16).

As illustrated in FIG. 6, the pressing force F1 toward the lower side in the Z direction is applied to the one end in the X direction of the fixing tool 30 by the flat spring portion 50. Further, the pressing force F3 toward the lower side in the Z direction is applied to the other end in the X direction of the fixing tool 30 (to the side corresponding to the positioning pole 35) by the positioning pin 110. Thus, even when the fixing tool 30 is in a temporarily-fixed state, lifting-off of the fixing tool 30 from the base plate 10 is prevented. That is, the fixing tool 30 remains positioned in the Z direction (in the thickness direction of the base plate 10).

The corner 35*a* at the upper end in the Z direction of the positioning pole 35 of the fixing tool 30 abuts against the tapered portion 112 of the positioning pin 110. Further, the fixing tool 30 is elastically pressed toward the positioning pin 110 by the flat spring portion 50. Thus, when the positioning pin 110 is fastened or loosened with respect to the base plate 10, the position in the X direction of the fixing tool 30 is changed.

More specifically, when the positioning pin 110 is fastened into the base plate 10, an abutting position of the corner 35*a* of the positioning pole 35 with respect to the tapered portion 112 is shifted to the upper part in the Z direction. Accordingly, the fixing tool 30 is shifted to the one side in the X direction (the left side in FIG. 6) against a spring force of the flat spring portion 50.

On the other hand, when the positioning pin 110 is loosened from the base plate 10, the abutting position of the corner 35*a* of the positioning pole 35 with respect to the tapered portion 112 is shifted to the lower part in the Z direction while being elastically pressed by the flat spring portion 50. Accordingly, the fixing tool 30 is shifted to the other side in the X direction (the right side in FIG. 6).

In this manner, the θ adjustment is performed while adjusting the position in the X direction of the fixing tool 30 using the positioning pin 110. Each of the screws 91, 92 is again additionally tightened after the θ adjustment to fasten and fix the liquid jet head 4 to the base plate 10.

The flat spring portion 50 and the positioning pin 110 prevent floating-off of the fixing tool 30 from the base plate 10 when the fixing tool 30 is in a temporarily-fixed state. That is, the fixing tool 30 (the support plate 72) remains positioned in the Z direction (the support plate 72 remains positioned in the thickness direction of the base plate 10). Thus, additional tightening of each of the screws 91, 92 does not result in subtle shift of the position of the fixing tool 30.

That is, when the fixing tool 30 in a temporarily-fixed state slightly lifts off from the base plate 10, the position of the fixing tool 30 is subtly shifted from the position before the floating-off. In this case, even when position adjustment is performed with the fixing tool 30 lifted, the fixing tool 30 is subtly shifted by additional tightening of each of the screws 91, 92. Accordingly, it is difficult to position the fixing tool 30 with high accuracy. However, additional tightening of each of the screws 91, 92 does not result in subtle shift of the position of the fixing tool 30 by preventing floating-off of the fixing tool 30 from the base plate 10 (allowing the fixing tool 30 to remain positioned in the Z direction) when the fixing tool 30 is in a temporarily-fixed state by the flat spring portion 50 and the positioning pin 110.

The positioning pin 110 is removed from the base plate 10 after the additional tightening of each of the screws 91, 92. On the other hand, the fixing tool 30 and the flat spring portion 50 remain attached to the base plate 10. Accordingly, the θ adjustment is completed. Note that the positioning pin 110 may remain attached until the following Y-direction adjustment is completed.

(Y-Direction Adjustment)

Next, adjustment in the Y direction (the longitudinal direction of the nozzle plate) of the liquid jet head 4 with respect to the base plate 10 will be described.

Figure 17:
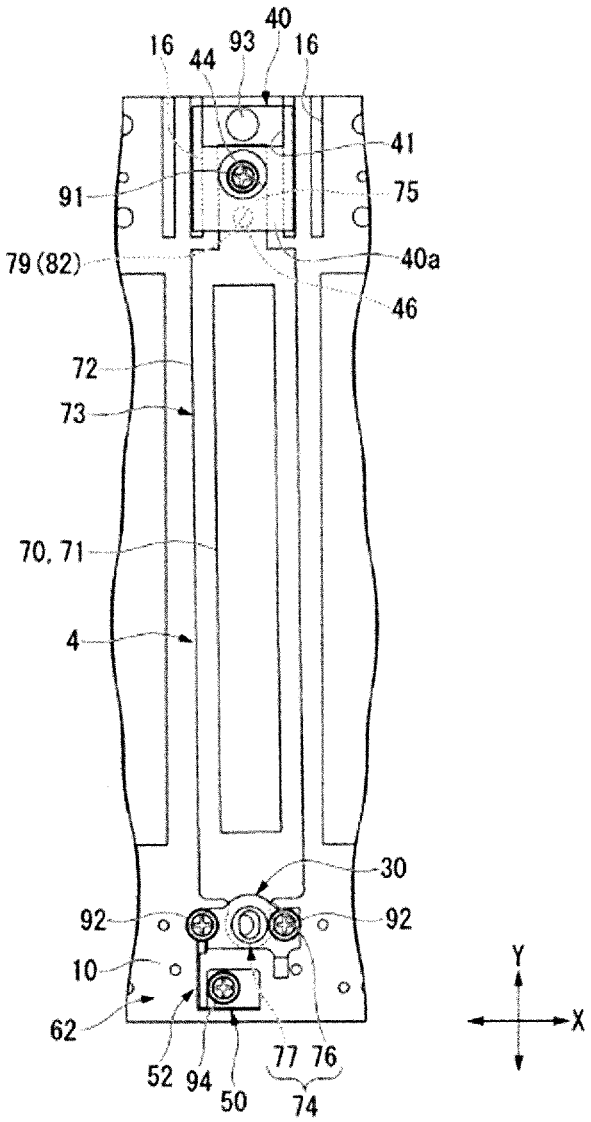
FIG. 17 is an explanatory diagram illustrating a Y-direction adjustment method of the liquid jet head with respect to the base plate in the embodiment of the present invention.

FIG. 17 is an explanatory diagram illustrating the Y-direction adjustment method of the liquid jet head 4 with respect to the base plate 10 and corresponds to FIG. 14.

As illustrated in FIG. 17, when the Y-direction adjustment is performed, the jig 40 is first set on the second engagement portion 75 of the support plate 72. At this time, the second engagement portion 75 is inserted into the lower face side recess 43 of the jig 40. The diameter of the through hole 44 (refer to FIG. 10) formed on the jig 40 is set to be larger than the diameter of the head 91*a* of the screw 91. Thus, the jig 40 can be set from the upper side of the second engagement portion 75 with the screw 91 fastened. Further, the projection 46 of the jig 40 is fitted with the engagement portion side second reference hole 82 of the second engagement portion 75.

Simultaneously with the setting of the jig 40, the screw 91 is slightly loosened so as to be brought into a temporarily-fixed state with no backlash. Further, when the support plate 72 is unmovable in the Y direction by the additional tightening of the screws 92 in the above θ adjustment, not only the screw 91, but also the screws 92 are slightly loosened. At this time, it is possible to prevent lifting-off and a shift in the X direction of the fixing tool 30 with respect to the base plate 10 by the attachment of the positioning pin 110. In this state, as illustrated in FIGS. 9 and 17, the reference pin 93 is inserted into the base side third reference hole 15 of the base plate 10 and the jig side third reference hole 42 of the jig 40.

As specifically illustrated in FIGS. 10 and 12, the X-direction width of the jig side third reference hole 42 is set to be substantially equal to the hole diameter of the base side third reference hole 15. Further, the Y-direction length of the jig side third reference hole 42 is set to be slightly larger than the hole diameter of the base side third reference hole 15.

The slide projections 45 are formed on both the X-direction sides of the jig 40 and project toward the base plate 10 from both the entire sides. The jig 40 is attached slidably in the Y direction (refer to arrow Y5 in FIG. 12) and unslidably in the X direction with respect to the base plate 10.

In addition, in the fixing tool 30, the first engagement portion 74 is held slidably in the Y direction (refer to arrow Y2 in FIG. 8) with respect to the fixing tool 30.

Thus, the jig 40 can be slid along the Y direction with respect to the base plate 10 with the θ adjustment completed. That is, sliding the jig 40 along the Y direction enables the support plate 72 (the liquid jet head 4) which is engaged with the jig 40 to slide along the Y direction with respect to the base plate 10 with the θ adjustment and positioning in the Z direction completed. Accordingly, the Y-direction adjustment is performed. The screw 91 (including the screws 92 as necessary) is again additionally tightened after the Y-direction adjustment to fasten and fix the liquid jet head 4 to the base plate 10 to complete the Y-direction adjustment.

Influences on the quality of images or characters on the recording medium S caused by a deviation in the distance in the X direction between the liquid jet heads 4 can be eliminated by adjusting the timing of ejecting ink. Thus, it is not particularly necessary to perform X-direction adjustment of the liquid jet head 4 with respect to the base plate 10.

In this manner, in the above embodiment, the liquid jet head 4 is provided with the support plate 72, and the liquid jet head 4 is attached to the base plate 10 of the carriage 62 through the support plate 72. The support plate 72 is provided with the first engagement portion 74 at the one end in the Y direction. The first engagement portion 74 is pressed against the base plate 10 using the fixing tool 30 to fix the first engagement portion 74 to the base plate 10.

The fixing tool 30 is slidable in the X direction with respect to the base plate 10. The first engagement portion 74 is slidable in the Y direction with respect to the fixing tool 30. In addition, when the fixing tool 30 is slid in the X direction with respect to the base plate 10, the fixing tool 30 can be slid in the X direction with the fixing tool 30 positioned in the Z direction (with the liquid jet head 4 positioned in the Z direction) by the flat spring portion 50 and the positioning pin 110.

That is, it is possible to perform positioning in one direction of the liquid jet head 4 while maintaining a positioned state in the other two directions. More specifically, it is possible to perform the θ adjustment while maintaining positions in the Y direction and the Z direction of the liquid jet head 4. Further, it is possible to perform the Y-direction adjustment while maintaining positions in the θ direction (X direction) and the Z direction of the liquid jet head 4.

Thus, it is possible to perform positioning of the liquid jet head 4 with ease and high accuracy with a simple structure.

In order to perform positioning in the X direction of the fixing tool 30, the positioning pin 110 and the flat spring portion 50 (the tip portion 52*b* and the pressing portion 53 of the spring body 52) which elastically presses the fixing tool 30 toward the positioning pin 110 are used. The tapered portion 112 is formed on the positioning pin 110, and the corner 35*a* of the positioning pole 35 in the fixing tool 30 abuts against the tapered portion 112.

Thus, it is possible to perform positioning in the X direction of the fixing tool 30 merely by fastening and loosening the positioning pin 110 with respect to the base plate 10. Thus, it is possible to easily perform positioning in the X direction of the fixing tool 30 with a simplified structure of the positioning pin 110.

The inclined plane 34 is formed by removing the corner of the fixing tool 30, and the pressing portion 53 which makes surface contact with the inclined plane 34 is formed on the tip portion 52*b* of the flat spring portion 50. Thus, the two pressing forces including the pressing force F1 toward the lower side in the Z direction and the pressing force F2 toward the other end in the X direction are generated on the one end in the X direction of the fixing tool 30 with a simplified shape of the flat spring portion 50. Thus, it is possible to reduce a manufacturing cost of the flat spring portion 50 and, in turn, a manufacturing cost of the carriage 62.

The present invention is not limited to the above embodiment and includes various modifications applied to the above embodiment without departing from the gist of the invention.

For example, the shape of the flat spring portion 50 and the shape of the positioning pin 110 are not limited to the above shapes. It is only required that at least lifting-off of the fixing tool 30 from the base plate 10 can be prevented when the fixing tool 30 is in a temporarily-fixed state (the screws 92 are in a slightly-loosened state). For example, only a spring member that merely presses the fixing tool 30 from the upper side in the Z direction may be provided. Further, in addition to the spring member, a spring member that presses the fixing tool 30 toward the positioning pin 110 may be provided. Furthermore, in this case, the tapered portion 112 may not be formed on the positioning pin 110.

In the above embodiment, the fixing tool 30 includes the first groove 32 which allows the screw 92 to be inserted therein and the second groove 33 which receives the first engagement portion 74. However, the present invention is not limited thereto. It is only required that the fixing tool 30 be slidable in the X direction with respect to the base plate 10, and the support plate 72 be slidable in the Y direction and turnable in the plane direction of the base plate 10 with respect to the fixing tool 30.

In the above embodiment, the slide grooves 16 each of which extends in the Y direction are formed on the base plate 10, and the slide projections 45 which are slidably fitted in the slide grooves 16 are formed on the jig 40. However, the present invention is not limited thereto. The slide grooves 16 may be formed on the jig 40, and the slide projections 45 may be formed on the base plate 10.

Furthermore, in the above embodiment, the Y-direction adjustment of the liquid jet head 4 (the support plate 72) with respect to the carriage 62 (the base plate 10) is performed using the jig 40. Alternatively, for example, a guide may be used instead of the jig 40 to slide the support plate 72 (the liquid jet head 4) in the Y direction. The shape of the through hole 44 formed on the second engagement portion 75 of the support plate 72 may be changed to slide the support plate 72 in the Y direction by the through hole 44 and the head 91*a* of the screw 91.

In the above embodiment, in the positioning of the liquid jet head 4 (the support plate 72) with respect to the carriage 62 (the base plate 10), the θ adjustment is first performed, and the Y-direction adjustment is performed thereafter. However, the present invention is not limited thereto. The θ adjustment and the Y-direction adjustment may be performed in a reversed order.

In the above embodiment, in fixing of the fixing tool 30 to the base plate 10, the fixing tool 30 is fastened and fixed using the screws 92. However, the present invention is not limited thereto. A fixing member other than the screw 92, the fixing member being attachable/detachable with respect to the base plate 10, may be used to fix the fixing tool 30 to the base plate 10.

Furthermore, the ink jet printer has been described as an example of the liquid jet recording apparatus 1. However, the present invention is not limited thereto. For example, the liquid jet recording apparatus 1 may be a fax machine or an on-demand printing machine.

Furthermore, in the above embodiment, the liquid jet recording apparatus 1 for a plurality of colors provided with a plurality of liquid jet heads 4 has been described. However, the present invention is not limited thereto. For example, the liquid jet recording apparatus may be a printer for a single color provided with one liquid jet head 4.

The shape of the carriage 62 (the base plate 10) may be changed according to the number of liquid jet heads 4. That is, the attachment openings 11 of the base plate 10 and the slide grooves 16 which are formed corresponding to the attachment openings 11 change according to the number of liquid jet heads 4.

What is claimed is:

1. A carriage comprising:

a base movable in a first direction;

a liquid jet head including a support plate attached to the base, the support plate elongated in a second direction that intersects the first direction and extends along a plane direction of the base;

a first engagement portion on one end in the second direction of the support plate;

a fixing tool for positioning and fixing the support plate with respect to the base, the fixing tool fixed to the base slidably in the first direction by a fixing member configured to be attachable/detachable with respect to the base and engaged with the first engagement portion; and a first pressing portion configured to press the fixing tool toward the base, wherein the support plate is supported on one face of the base turnably along the one face, and the fixing tool is slidable in the first direction using the fixing member as a guide, and is configured to allow movement in the second direction of the first engagement portion with respect to the fixing tool, and to restrict movement in the first direction of the first engagement portion and movement in a thickness direction of the base of the first engagement portion with respect to the fixing tool.

2. The carriage according to claim 1, further comprising:

a positioning pin detachably attached to the base and configured to position the fixing tool in the first direction and the thickness direction; and a second pressing portion configured to press the fixing tool toward the positioning pin.

3. The carriage according to claim 2, wherein the positioning pin includes:

a tapered portion whose diameter is gradually reduced toward a tip thereof; and a pin thread portion on the tip of the tapered portion and screwed with the base along the thickness direction of the base, and a corner of the fixing tool abuts against the tapered portion.

4. The carriage according to claim 3, wherein the first pressing portion and the second pressing portion comprise a flat spring, the fixing tool includes an inclined plane on a face opposite to the base at a side part opposite to the positioning pin, and the first pressing portion and the second pressing portion abut against the inclined plane.

5. A liquid jet recording apparatus comprising:

the carriage according to claim 1;

a liquid jet head on the carriage;

a scanning unit configured to move the carriage;

a liquid storage body configured to store liquid; and a liquid supply tube configured to circulate the liquid, the liquid supply tube between the liquid jet head and the liquid storage body.

* * * * *